US006289531B1

(12) United States Patent
Kahle et al.

(10) Patent No.: US 6,289,531 B1
(45) Date of Patent: Sep. 18, 2001

(54) FAUCET VALVE FIXTURE

(75) Inventors: Dieter Kahle, Hemer; Eberhard Stolle, Hagen, both of (DE)

(73) Assignee: Friedrich Grohe AG & Co. KG, Hemer (DE)

( * ) Notice: Subject to any disclaimer, the term of this patent is extended or adjusted under 35 U.S.C. 154(b) by 0 days.

(21) Appl. No.: 09/456,213

(22) Filed: Dec. 7, 1999

(30) Foreign Application Priority Data

Dec. 8, 1998 (DE) ..... 198 56 553

(51) Int. Cl.[7] ..... E03C 1/04
(52) U.S. Cl. ..... 4/678; 137/801
(58) Field of Search ..... 4/675–678; 137/801, 137/359, 625.4

(56) References Cited

U.S. PATENT DOCUMENTS

| | | | | |
|---|---|---|---|---|
| 3,035,612 | * | 5/1962 | Lyon | 137/625.4 |
| 4,827,538 | * | 5/1989 | Heimann et al. | 4/677 |
| 5,022,429 | * | 6/1991 | Rollini et al. | 4/675 |
| 5,027,851 | * | 7/1991 | Drees et al. | 4/675 |
| 5,095,554 | * | 3/1992 | Gloor | 4/678 |
| 5,730,176 | * | 3/1998 | Heimann et al. | 137/359 |
| 6,058,972 | * | 5/2000 | Kahle et al. | 137/625.4 |

FOREIGN PATENT DOCUMENTS

| | | | |
|---|---|---|---|
| 31 20 210 | | 12/1982 | (DE) . |
| 195 23 884 | | 1/1997 | (DE) . |
| 577164 | * | 1/1994 | (EP) ..... 4/676 |
| 0632220 | | 1/1995 | (EP) . |
| 2100841 | | 1/1983 | (GB) . |

* cited by examiner

*Primary Examiner*—Charles R. Eloshway
(74) *Attorney, Agent, or Firm*—Herbert Dubno; Andrew Wilford

(57) ABSTRACT

A plumbing fixture has a hollow housing formed with a first tubular collar extending along a first axis and a second tubular collar extending along a second axis transverse to the first axis. The housing is secured to a deck with the first collar engaging the deck. A holder mounted in the first collar has an end aligned in the housing with the second axis and a valve mount in the housing is fixed on the holder end. An inlet pipe and an outlet pipe extend through the first collar and are connected to the valve mount. A valve cartridge in the housing is releasably secured to the valve mount by fasteners accessible through the second collar.

14 Claims, 6 Drawing Sheets

FAUCET VALVE FIXTURE

FIELD OF THE INVENTION

The present invention relates to a faucet valve fixture. More particularly this invention concerns a faucet assembly with a mixing valve set up for one-hole installation.

BACKGROUND OF THE INVENTION

A standard mixing-valve faucet fixture has a housing containing a valve cartridge and mounted on a deck. Hot- and cold-water inlet pipes extend through the deck into the housing where they are connected to the cartridge and an outlet pipe extends from the cartridge to a faucet, or to a hose connected to a spray head that may form the end of a faucet. A handle on the housing operates the cartridge to control the mix of hot and cold water fed from the inlet pipes to the outlet pipe as well as the flow volume.

Normally the cartridge is secured as described in German patent document 3,120,210 of Gottwald and Koster by means of screws whose heads are visible on the outside of the housing. Not only is this type of installation unattractive, but the heads are subject to fouling and corrosion so that subsequent removal and replacement of the cartridge can be problematic.

OBJECTS OF THE INVENTION

It is therefore an object of the present invention to provide an improved plumbing fixture.

Another object is the provision of such an improved plumbing fixture which overcomes the above-given disadvantages, that is which is if clean appearance and that is easy to assemble and service.

SUMMARY OF THE INVENTION

A plumbing fixture has according to the invention a hollow housing formed with a first tubular collar extending along a first axis and a second tubular collar extending along a second axis transverse to the first axis. The housing is secured to a deck with the first collar engaging the deck. A holder mounted in the first collar has an end aligned in the housing with the second axis and a valve mount in the housing is fixed on the holder end. An inlet pipe and an outlet pipe extend through the first collar and are connected to the valve mount. A valve cartridge in the housing is releasably secured to the valve mount by fasteners accessible through the second collar.

Thus with this system there are no external fasteners; instead the exterior of the housing is completely smooth and uninterrupted. It is possible to make the housing of thin sheet metal by hydroforming, the only machining necessary being that at the mouths of the collars. The resultant structure is therefore very attractive and protects the fasteners for the valve cartridge so the cartridge can be removed and changed easily if necessary.

When according to the invention the holder is of sheet metal both the holder and housing can be of stainless steel welded together by spot welds. Alternately the holder is of brass and is soldered to the housing.

Furthermore in accordance with the invention the holder is formed with an arcuate mounting bracket fixed in the first collar, a pair of parallel arms extending generally parallel to the second axis, and respective mounting tabs on the arms extending generally perpendicular to the second axis and directly engaging the valve mount. Each tab is formed with a threaded bore and respective screws are engaged through the valve mount with the bores.

The valve mount according to the invention is a metallic plate having a front face against which the fasteners secures the valve cartridge and which is formed with respective threaded bores. The fasteners are screws engaged through the cartridge with the bores. In addition the valve mount is formed with respective passages connected to the inlet and outlet pipes and opening at the front face. It is also within the scope of this invention for the valve mount to have a back face and a passage connected to the outlet pipe and opening at the back face. In this case the fixture further has a vent body releasably secured to the back face and holding a vent. The valve mount is formed on the back face with threaded bores and respective screws extend through the vent body into the back-face bores.

The housing in accordance with the invention is formed with a third collar axially aligned with the first collar. An outlet hose connected to the outlet pipe extends along the first axis through the housing out of the third collar.

The housing includes an internally threaded ring fitted in the third collar and an externally threaded mounting tube extending along the first axis and having one end threaded in the ring and another end passing through the deck. A nut engaged in the other tube end bears on the deck to secure the housing to it. The hose passes through the mounting tube. A seal ring is engaged between the first collar and the deck.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
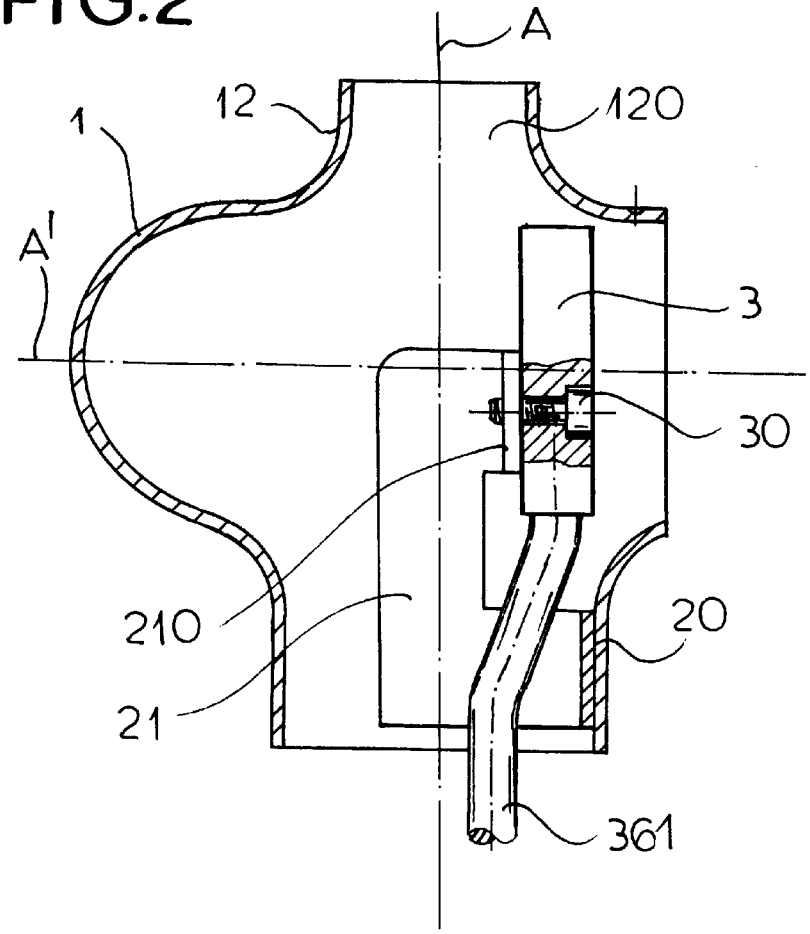
FIG. 2 is a vertical section through the housing, holder, and valve mount of this invention.
Figure 3:
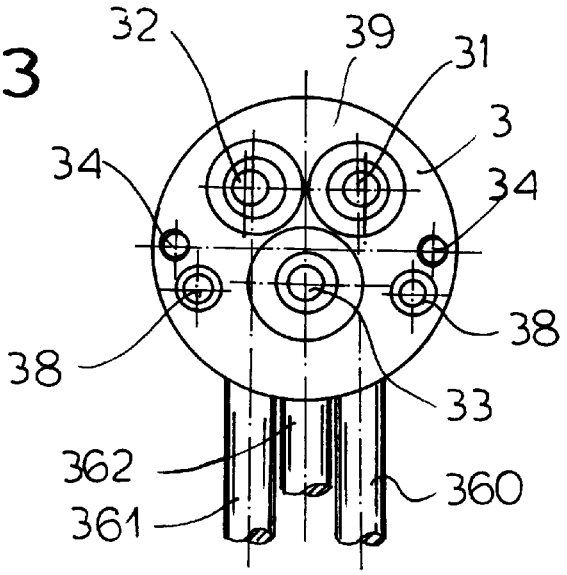
FIG. 3 is a front view of the valve mount.
Figure 4:
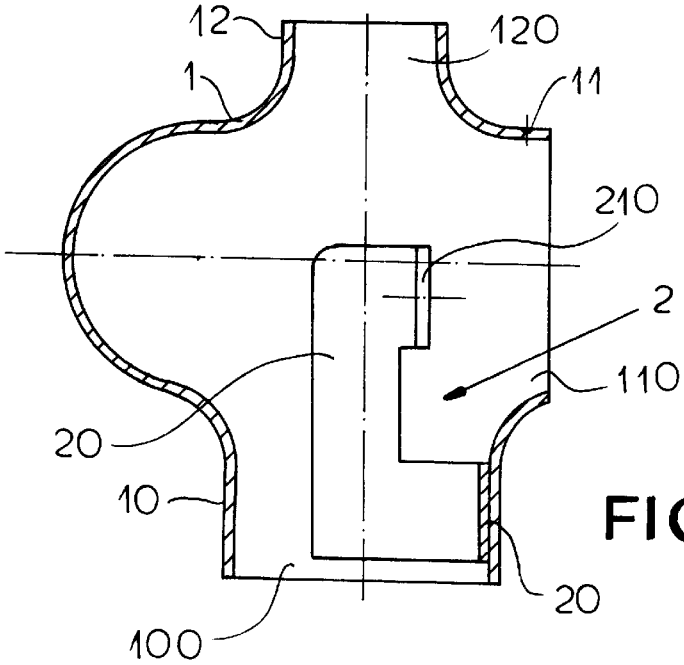
FIG. 4 is a vertical section through the housing and holder.
Figure 9:
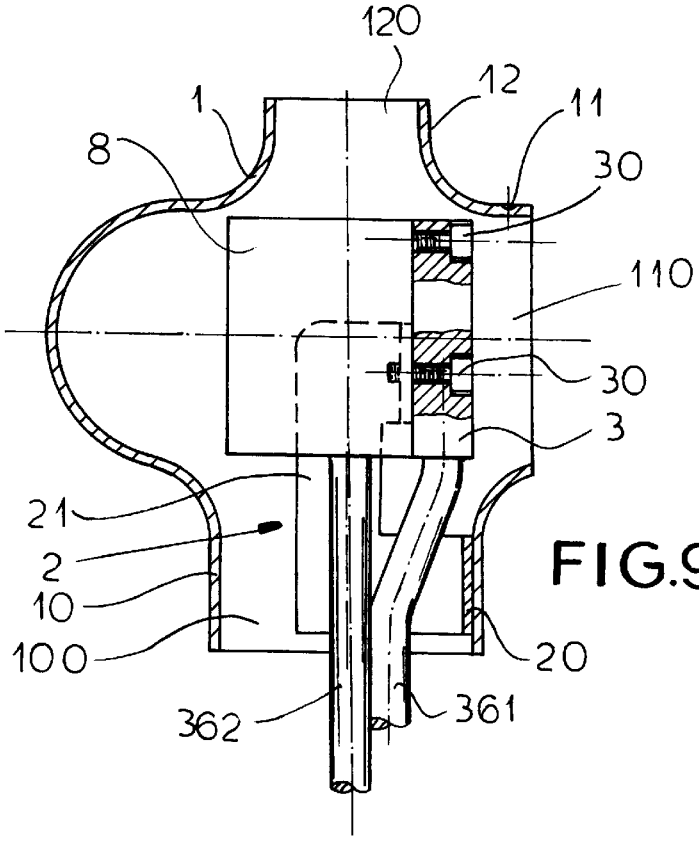
FIG. 9 is a vertical section through the housing, holder, and valve mount of the fixture of FIG. 8.

As seen in FIGS. 1 through 7, a deck-mount single-control faucet assembly has a hollow stainless-steel housing 1 provided internally with a holder 2 on which is carried structure including a valve mount 3 in turn carrying a valve cartridge 4. The housing 1 is fixed to a deck 7 over a hole 70 therein. Here the deck 7 is horizontal but it could also be a vertical wall surface. The housing 1 is formed as best shown in FIG. 4 centered on a normally vertical axis A with a cylindrical lower collar 10 defining an opening 100 and a coaxial upper collar 12 defining an opening 120 as well as with a side collar 11 defining an opening 110 centered on an axis A' perpendicular to the axis A. The upper collar 12 is fitted with a threaded insert ring 121 in which is seated a faucet arm shown partially at 5. A central mounting tube 6 has an upper screwthread 60 engaged with an internally threaded lower end 122 of the faucet 5 and there-through with the ring 121 and a lower screwthread 60 engaged with a nut assembly 61 securing the housing 1 to the deck 7, with a seal ring 13 compressed between the edge of the collar 10 and the deck 7.

Figure 5:
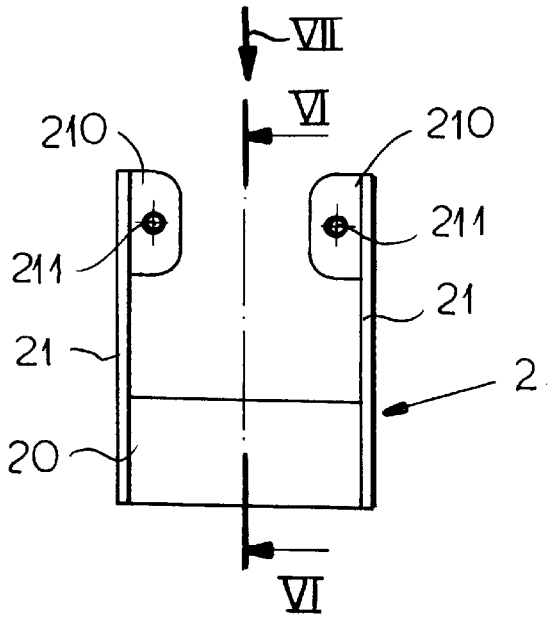
FIG. 5 is a front view of the holder.
Figure 6:
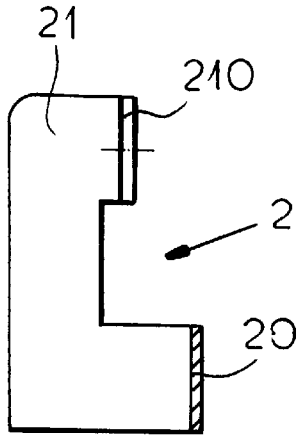
FIG. 6 is a section taken along line VI—VI of FIG. 5.
Figure 7:
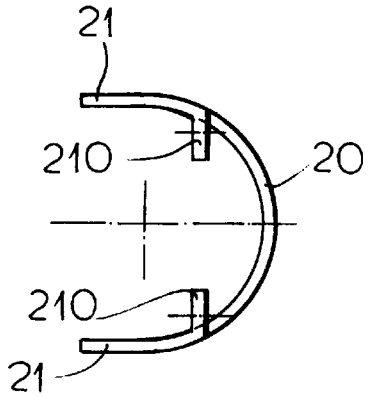
FIG. 7 is a top view taken in the direction of arrow VII of FIG. 5.
Figure 8:
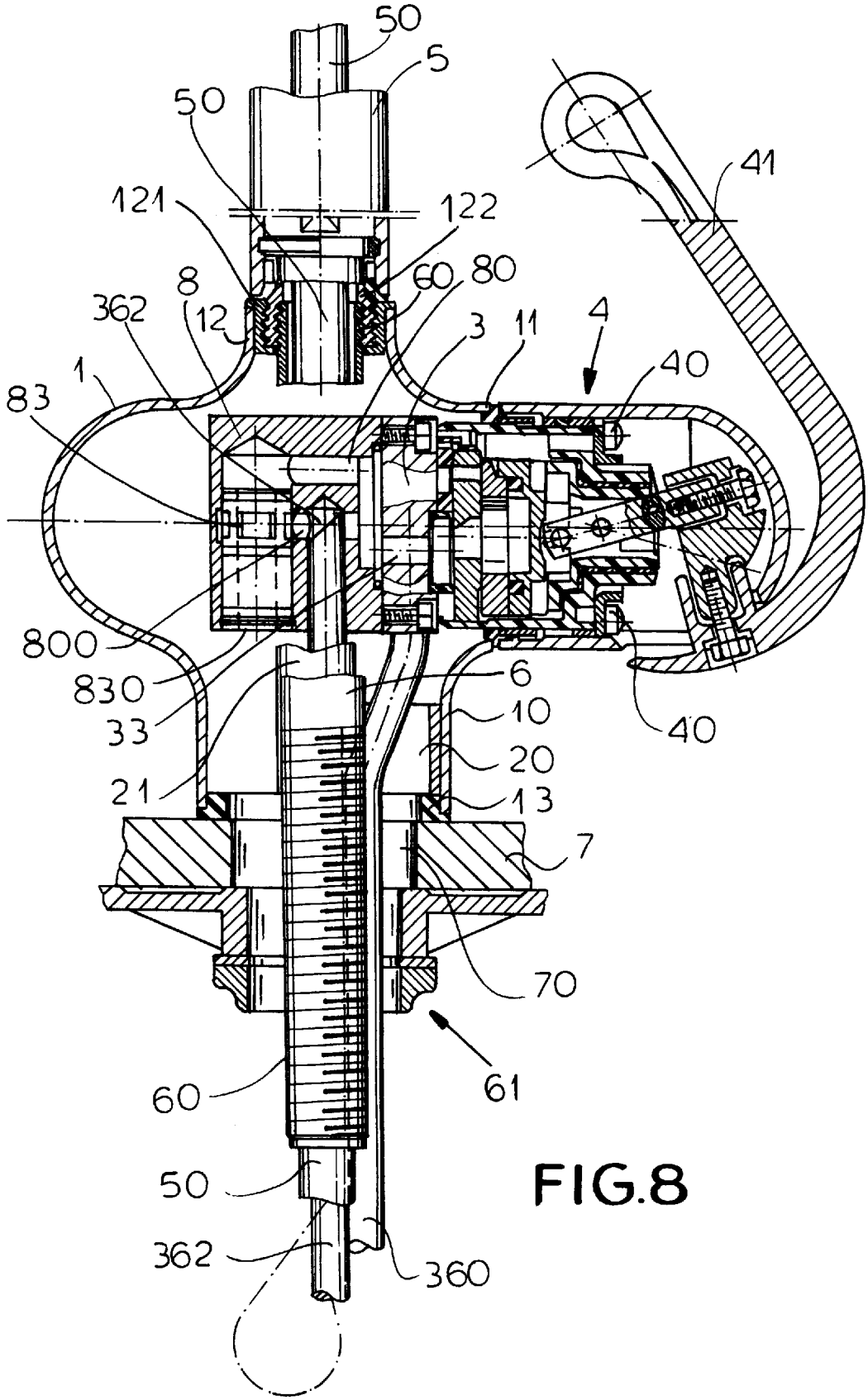
FIG. 8 is a vertical section through another fixture in accordance with the invention.
Figure 10:
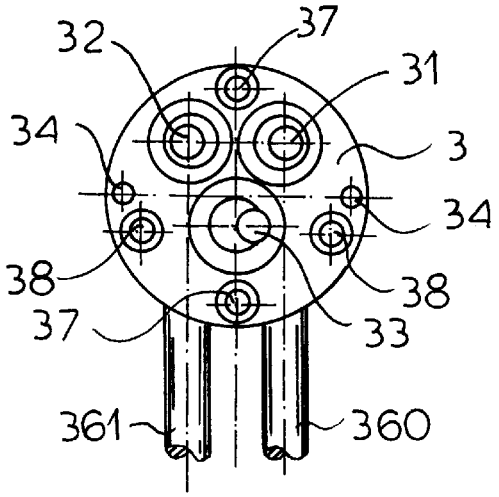
FIGS. 10 and 11 are front and side views of the valve mount of FIG. 9.
Figure 11:
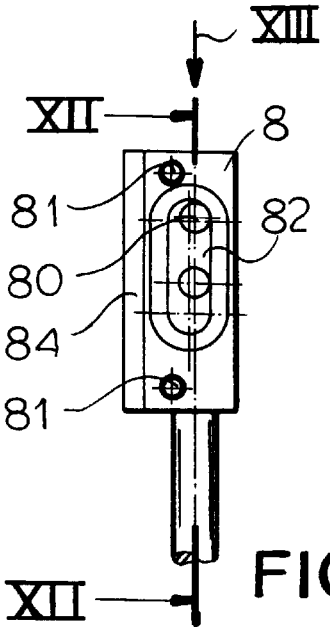

The holder 2 as best seen in FIGS. 5, 6, and 7 comprises a bight-like arcuate mounting bracket 20 extending over 90° to 140° and welded or soldered to the housing 1 inside the collar 10 and a pair of parallel arms 21 from which extend tabs 210 formed with threaded mounting bores 211 for the valve mount 3. When both the holder 2 and housing 1 are made of stainless steel, they are secured together by simple spot welds but when the holder 2 is made of another metal such as brass it is secured in place by brazing or soldering.

Figure 1:
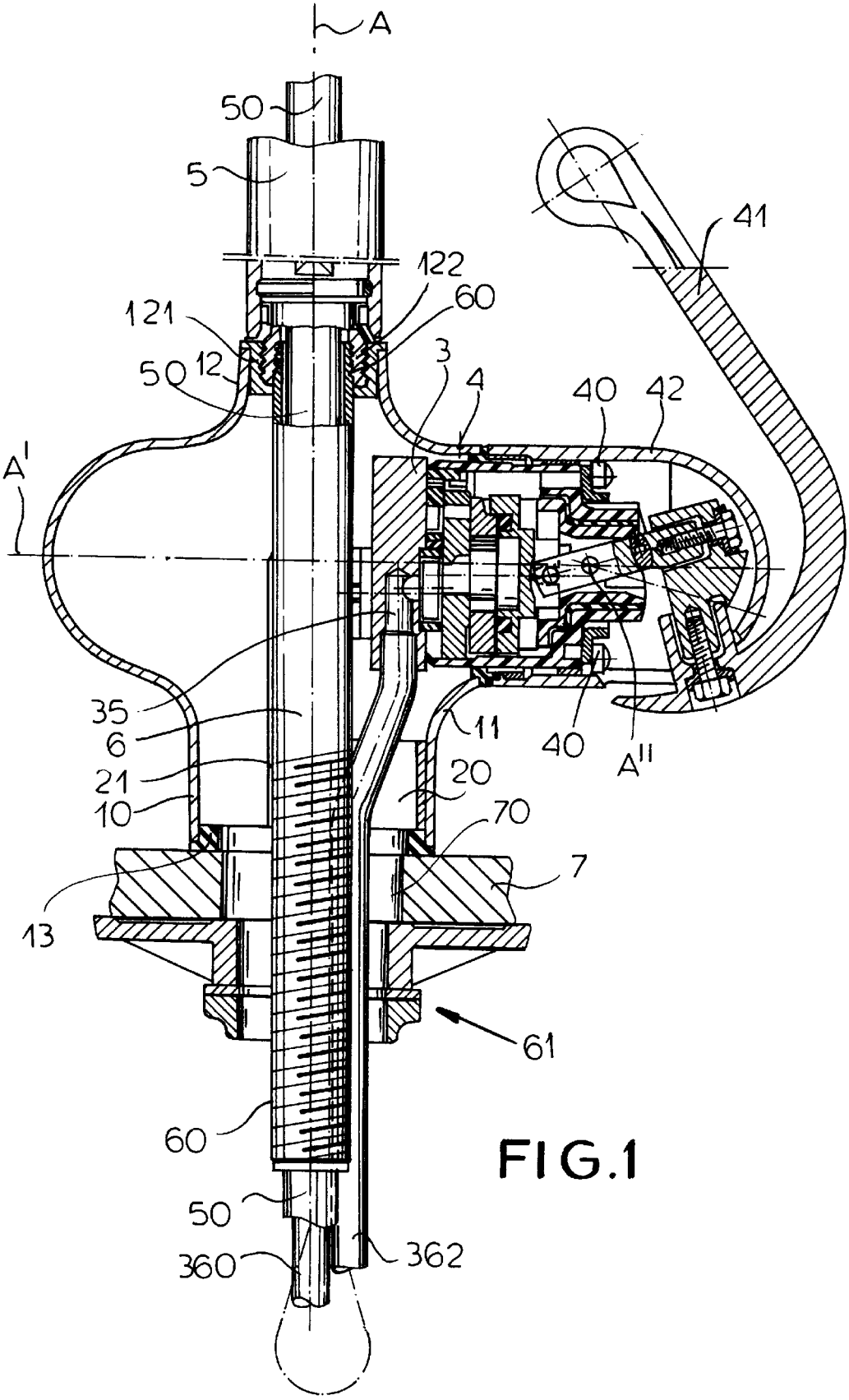
FIG. 1 is a vertical section through the fixture according to the invention.

The valve mount 3 as shown in FIGS. 1, 2, and 3 is formed as a cylindrical disk and has a face 39 formed with a pair of counterbored holes 38 through which screws 30 engage in the bores 211 to fix the mount 3 on the holder 2. In addition this face 39 is formed with three ports 31, 32, and 33 communicating via bores 35 with pipes 360, 361, and 362 that extend down through the collar 10 and the hole 70 to a location below the deck 7. The pipes 360 and 361 are connected to pressurized hot- and cold-water supplies and the central pipe 362 also passes down through the deck 7 and is connected to the end of a hose 50 extending up through the mounting tube 6 and connected to an unillustrated spray head on the end of the faucet 5.

A standard disk-type valve cartridge 4 is secured by screws 40 seated in bores 34 to the face 39 to align inlet and outlet ports of the cartridge 4 with the ports 31, 32, and 33. The cartridge 4 carries a handle 41 which is normally tipped about a horizontal axis A" perpendicular to a plane of the axes A and A' to vary a volume of flow from the inlet pipes 360 and 361 to the outlet pipe 362 and thence to the hose 50 while tipping the handle 41 about the axis A' varies the mix of hot and cold water delivered to the faucet 5 as is well known in the art. A cover 42 is snapped over the cartridge 4.

In the arrangement of FIGS. 8 to 13 the structure including the mount 3 furtherhas a vent body 8 formed with threaded bores 81 in which are seated screws 30 extending through holes 37 in the mount 3 to secure the body 8 to a back face of the valve mount 3. The valve mount 3 is modified in that the only two connections 360 and 361 for cold and hot water are connected to the respective passages 35. In addition the port 33 for mixed water extends straight through the mount 3 and opens into a cavity 82 of the body 8. An O-ring 820 forms a tight seal between the body 8 and a back face of the mount 3.

Figure 12:
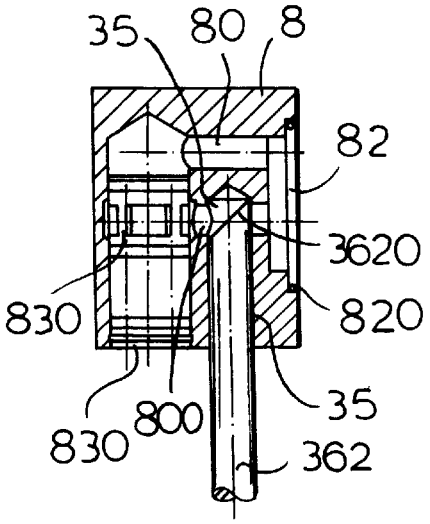
FIG. 12 is a section taken along line XII—XII of FIG. 11.
Figure 13:
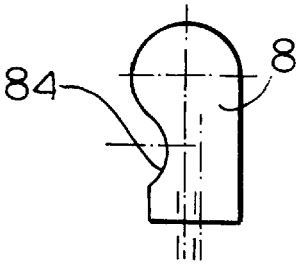
FIG. 13 is a top view taken in the direction of arrow XIII of FIG. 11.

The vent body is formed with a passage 80 extending from the cavity 82 and leading to a standard vent 83 itself opening via a radial passage 800 into the passage 35 of the mixed water pipe 362. The vent 83 is connected via a passage 830 with the atmosphere. In order that the bore 800 is externally closed, the pipe 362 is formed with an angled end 3620 as best shown in FIG. 12. The body 8 is formed with a cutout 84 (FIG. 13) that allows the tube 6 to pass by it when the fixture is being assembled.

This system is put together by first inserting the valve mount 3 through the opening 110 into the housing 1 and then securing it in place on the tabs 210 by the screws 30. Then the vent body 80 with the vent 83 and connected to the pipe 362 is passed through the opening 100 and further screws are inserted through the holes 37 into the bores 81 to fix it in place.

Thereafter the tube 6 is installed, the faucet 5 is mounted in place, and the hose 50 is threaded through the tube 6.

What is claimed is:

1. A plumbing fixture comprising:

a hollow housing formed with a first tubular collar extending along a first axis and a second tubular collar extending along a second axis transverse to the first axis;

means for securing the housing to a deck with the first collar engaging the deck;

a holder mounted in the first collar and having an end aligned in the housing with the second axis;

structure in the housing on the holder end;

an inlet pipe and an outlet pipe extending through the first collar and connected to the structure;

a valve cartridge in the housing; and fastener means accessible through the second collar for releasably securing the cartridge to the structure.

2. The plumbing fixture defined in claim 1 wherein the holder is of sheet metal.

3. The plumbing fixture defined in claim 1 wherein the holder and housing are of stainless steel and are welded together.

4. The plumbing fixture defined in claim 1 wherein the holder is of brass and is soldered to the housing.

5. The plumbing fixture defined in claim 1 wherein the holder is formed with an arcuate mounting bracket fixed in the first collar, a pair of parallel arms extending generally parallel to the second axis, and respective mounting tabs on the arms extending generally perpendicular to the second axis and directly engaging the structure.

6. The plumbing fixture defined in claim 5 wherein each tab is formed with a threaded bore, the fixture further comprising respective screws engaged through the structure with the bores.

7. The plumbing fixture defined in claim 1 wherein the structure includes a mount formed as a metallic plate having a front face against which the fastener means secures the valve cartridge and formed with respective threaded bores, the fastener means including respective screws engaged through the cartridge with the bores.

8. The plumbing fixture defined in claim 7 wherein the structure is formed with respective passages connected to the inlet and outlet pipes and opening at the front face.

9. The plumbing fixture defined in claim 7 wherein the mount has a back face and a passage connected to the outlet pipe and opening at the back face, the structure further comprising a vent body releasably secured to the back face and holding a vent.

10. The plumbing fixture defined in claim 9 wherein the mount is formed on the back face with bores, the fixture further comprising respective screws extending through the vent body into the back-face bores.

11. The plumbing fixture defined in claim 1 wherein the housing is formed with a third collar axially aligned with the first collar, the fixture further comprising an outlet hose connected to the outlet pipe and extending along the first axis through the housing out of the third collar.

12. The plumbing fixture defined in claim 11 wherein the housing includes a ring fitted in the third collar, and an externally threaded mounting tube extending along the first axis and having one end fixed in the ring and another end passing through the deck, the means for securing including a nut engaged with the other tube end and bearing on the deck.

13. The plumbing fixture defined in claim 11 wherein the hose passes through the mounting tube.

14. The plumbing fixture defined in claim 11, further comprising a seal ring engaged between the first collar and the deck.

* * * * *